US011253046B2

(12) United States Patent
Miller

(10) Patent No.: US 11,253,046 B2
(45) Date of Patent: Feb. 22, 2022

(54) SHAMPOO BOWL, SHAMPOO BOWL ARRANGEMENT AND SHAMPOO BOWL SYSTEM

(71) Applicant: Matthew Miller, Flowery Branch, GA (US)

(72) Inventor: Matthew Miller, Flowery Branch, GA (US)

( * ) Notice: Subject to any disclaimer, the term of this patent is extended or adjusted under 35 U.S.C. 154(b) by 0 days.

(21) Appl. No.: 16/731,532

(22) Filed: Dec. 31, 2019

(65) Prior Publication Data

US 2020/0275762 A1 Sep. 3, 2020

Related U.S. Application Data

(60) Provisional application No. 62/812,377, filed on Mar. 1, 2019.

(51) Int. Cl.
*A45D 44/10* (2006.01)
*A45D 19/08* (2006.01)

(52) U.S. Cl.
CPC ..... *A45D 44/10* (2013.01); *A45D 19/08* (2013.01)

(58) Field of Classification Search
CPC ..... A45D 44/10; A45D 19/06; A45D 19/08; A45D 19/10; A45D 19/00
USPC ..... 4/515, 519, 520, 523
See application file for complete search history.

(56) References Cited

U.S. PATENT DOCUMENTS

D93,105 S 8/1934 Hudson
3,906,962 A 9/1975 Strickland et al.
4,196,478 A 4/1980 Cowell
4,821,347 A 4/1989 Nash
5,245,713 A * 9/1993 Tickle ..... A45D 19/10 4/516
5,896,595 A * 4/1999 Spencer ..... A45D 19/10 4/519
5,946,745 A 9/1999 Magee
5,966,751 A * 10/1999 Chiarelli ..... A45D 19/04 4/516
6,604,251 B2 * 8/2003 Minami ..... A45D 19/10 4/515
6,925,660 B1 * 8/2005 Cartwright ..... A45D 19/10 4/523

(Continued)

FOREIGN PATENT DOCUMENTS

JP 2011161076 A 8/2011

*Primary Examiner* — J C Jacyna
(74) *Attorney, Agent, or Firm* — Carmody Torrance Sandak & Hennessey LLP

(57) ABSTRACT

A shampoo bowl and neck/head rest combination wherein the shampoo bowl for receiving the neck and/or head area has a recessed area for receiving the neck/head rest below a top edge of the shampoo bowl. In another embodiment, a shampoo bowl arrangement comprises a bowl, the bowl dimensioned to receive a neck area and/or a head area of a person during a hair washing, hair cutting, massaging and/or hair coloring procedure; and one or more accessories, couplable to the bowl and utilizable during the hair washing, hair cutting, massaging and/or hair coloring procedure. In a preferred embodiment, a cushion is provided, wherein the cushion extends along at least a portion of a top edge of the shampoo bowl, and wherein the one or more accessories are coupled to the cushion and the cushion and the neck/head rest are integrated as one unit (e.g. one piece of material).

17 Claims, 9 Drawing Sheets

(56) References Cited

U.S. PATENT DOCUMENTS

| | | | | |
|---|---|---|---|---|
| 2001/0032356 | A1* | 10/2001 | Shimizu | A45D 19/14 4/515 |
| 2004/0148692 | A1* | 8/2004 | Johnson | A45D 19/10 4/515 |
| 2005/0166938 | A1* | 8/2005 | Hoepfl | A45D 19/00 132/200 |
| 2006/0042001 | A1* | 3/2006 | Takada | A47C 1/10 4/515 |
| 2008/0184474 | A1* | 8/2008 | Smyth | A45D 44/10 4/523 |
| 2011/0185492 | A1* | 8/2011 | Brown | A45D 44/10 4/523 |
| 2013/0160786 | A1* | 6/2013 | Fujioka | A45D 19/14 132/200 |
| 2019/0261759 | A1* | 8/2019 | Layton | A45D 19/10 |

* cited by examiner

SHAMPOO BOWL, SHAMPOO BOWL ARRANGEMENT AND SHAMPOO BOWL SYSTEM

This application claims the benefit of U.S. application Ser. No. 62/812,377 filed on Mar. 1, 2019. The subject matter of said application Ser. No. 62/812,377 is incorporated by reference as if fully set forth herein.

BACKGROUND OF THE INVENTION

The present invention is generally directed to shampoo bowls, and more particularly, to an improved shampoo bowl dimensioned to receive a neck/head rest that achieves superior neck and head comfort to the person whose neck/head is resting thereon. In addition, the present invention is directed to a shampoo bowl arrangement and system that preferably comprises an improved cushion that can support one or more accessories, couplable to the bowl, which facilitate a hair washing, hair cutting, massaging and/or hair coloring procedure and that provides improved comfort for the stylist or other hair care personnel attending to the person's head resting thereon. In a preferred embodiment, the cushion and neck/head rest are integrated as a single unit (e.g. single piece of material). Such embodiments provide other advantages and benefits as discussed herein. Although not limited thereto, the present invention is particularly advantageous for use in a salon or hospital.

Shampoo bowls for salons, hospitals or the like are well known, examples of which are described and illustrated in U.S. Design Pat. No. D93105, U.S. Pat. Nos. 3,906,962, 4,821,347, 5,946,745, 6,604,251, 4,196,478 as well as JP No. JP2011161076A. However, none of these examples, nor any others shampoo bowls known to the present inventor, provide sufficient comfort to the person whose hair is being attended to, whether for hair washing, hair cutting, massaging, hair coloring or the like. Moreover, while hair salons may have recognized the desire to provide the hair care personnel with accessories nearby during the hair care procedures, none of the known examples are known to have incorporated such accessories as disclosed and claimed herein. Because of these deficiencies in the prior art, the functionality and convenience of the state-of-the-art shampoo bowls have been less than satisfactory. Furthermore, the comfort of and convenience afforded to the person providing the treatment has also been less than satisfactory, and therefore, improving the comfort, efficiency and convenience of the stylist/hair care personnel while attending to the hair of the person is also an objective of the present invention. The prior art is also woefully deficient in being able to simultaneously provide superior comfort and convenience to both the person providing the treatment and superior comfort to the person receiving the treatment by for example, utilizing a cushion as disclosed herein and a neck/head rest as disclosed herein being integrated as a single unit.

Therefore, additional improvements to the design and construction of shampoo bowls are desirable. For example and not limitation, it would be desirable to be provide a shampoo bowl system that provides additional comfort to the person who is having their hair attended to, by way of a hair washing, hair cutting, massaging, hair coloring, hair treatment or the like. It is also desirable to provide a shampoo bowl system that provides for additional comfort to the person providing the services to the person while performing the hair washing, hair cutting, massaging, hair coloring or the like. It is also desirable to provide a shampoo bowl system that makes hair washing, hair cutting, hair massaging, hair coloring procedures more convenient and efficiently attained, such as by providing a shampoo bowl system construction that facilities the procedures being performed. It is thus believed that further advances to the state of the art are both desirable and achievable, all of which are provided by the embodiments disclosed herein.

SUMMARY AND OBJECTIVES OF THE INVENTION

It is thus an objective of the present invention to overcome the perceived deficiencies in the prior art.

Specifically, it is an objective of the present invention to provide a shampoo bowl system that provides improved neck and head comfort to those whose head/hair is being treated thereon or therein.

Still a further objective of the present invention is to provide an improved shampoo bowl system for treating a person's head/hair during a washing, hair cutting, and/or hair coloring procedure.

A further objective is to provide a shampoo bowl system that not only provides comfort for the person receiving the hair cutting, watching, massaging and/or coloring treatment, but also provides increased functionality for, comfort to, and additional advantages to the stylist or specialist treating and/or attending to the customer or patient.

An additional objective of the present invention is to provide a shampoo bowl system that incorporates other tools and features to make the shampoo bowl of the present invention more functional for hairdressers and other professionals or personnel using the bowl during a hair washing, hair cutting, massaging, hair coloring, hair treatment or the like.

Other objectives and advantages of the present invention will become more apparent from a consideration of the drawings and ensuing disclosure.

The invention accordingly comprises the features, combinations of elements and features, arrangement of parts and methods for using the same which will be exemplified in the description and illustrations hereinafter set forth, and the scope of the invention will be indicated in the claims.

Therefore, to overcome the features in the prior art and to achieve the objects and advantages set forth above and below, a first preferred embodiment of the present invention is, generally speaking, directed to a shampoo bowl and neck/head rest combination, comprising the shampoo bowl, having at least one side for receiving a neck area and/or a head area of a person receiving a hair washing, hair cutting, massaging and/or hair coloring procedure, wherein the at least one side of the shampoo bowl for receiving the neck and/or head area has a recessed area for receiving the neck/head rest; and wherein a portion of the neck/head rest that is positioned at a lowermost edge of the recessed area is at least three (3) inches thick, and preferably is at least three and one half (3.5) inches to five (5) inches thick.

In a specific preferred embodiment, the shampoo bowl and neck/head rest combination further comprising a cushion, wherein the cushion extends along at least a portion of a top edge of the shampoo bowl, the cushion and the neck/head rest are an integrated unit, and the recessed area for the neck/head rest is at least five (5) inches below a top edge of the cushion.

In another preferred embodiment, the present invention is directed to, generally speaking a shampoo bowl arrangement comprising a bowl, the bowl dimensioned to receive a neck area and/or a head area of a person during a hair washing, hair cutting, massaging and/or hair coloring procedure; and one or more accessories, couplable to the bowl and utilizable during the hair washing, hair cutting, massaging and/or hair coloring procedure. In a specific preferred embodiment, the one or more accessories comprises at least one (and preferably at least two) hair sectioner(s), where the at least one hair sectioner comprises a plurality of slots to which one or more clips are securable, and whereby one or more sections of hair are couplable to the at least one hair sectioner with the one or more clips being couplable to the one or more of the plurality of slots. In another specific preferred embodiment, the at least one hair sectioner further comprises a receptacle with an opening at a bottom thereof for receiving a liquid dispensing tip of an inverted bottle, wherein the tip is extendable into the opening of the receptacle while the inverted bottle is retainable in the receptacle. In yet another specific preferred embodiment, the one or more accessories comprises at least one removable bowl for receiving hair coloring liquid and/or conditioning treatment.

And in yet another preferred embodiment, the shampoo bowl arrangement comprises a cushion, wherein the cushion extends along at least a portion of a top edge of the shampoo bowl, and wherein the one or more accessories are coupled to the cushion.

BRIEF DESCRIPTION OF THE DRAWINGS

The above set forth and other features of the present invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DETAILED DESCRIPTION OF THE PREFERRED EMBODIMENTS

Figure 1:
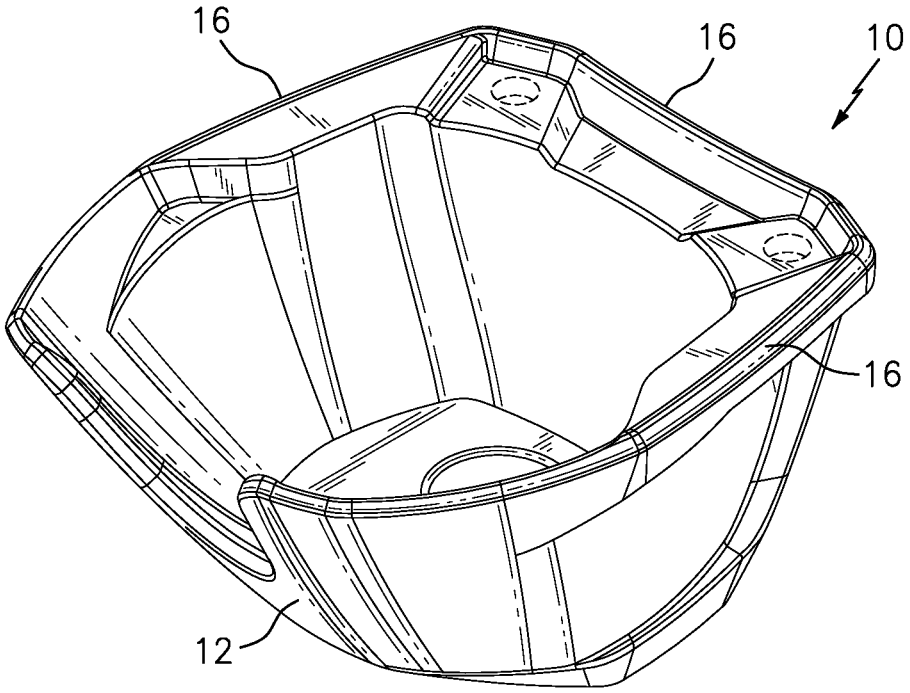
FIGS. 1 and 2 are perspective views of a shampoo bowl constructed in accordance with preferred embodiments of the present invention.

Generally speaking, the present invention is directed to a shampoo bowl, generally indicated at 10, as shown in the Figures. In a preferred embodiment, shampoo bowl 10 comprises a neck/head rest, generally indicated at 20, that provides for improved neck and head comfort for the person whose head is resting thereon and/or therein. In another preferred embodiment, the present invention incorporates a cushion, generally indicated at 30, which provides improved comfort for the person (e.g. stylist or hospital worker) attending to the person's head/hair, as well as other advantages and benefits as disclosed herein. Although not limited thereto, shampoo bowl 10, neck/head rest 20, and cushion 30, whether incorporated into a single unit as preferred, or whether provided separately, are particularly advantageous for use in a salon or hospital.

Generally speaking, shampoo bowl 10, neck/head rest 20 and cushion 30, their respective constructions and functionality as disclosed herein, facilitate among other things, the shampooing, cutting, treatment, coloring, and/or massaging of a person's head and/or hair.

As will be appreciated herein, shampoo bowl 10 and neck/head rest 20, preferably in combination, provides improved neck and head comfort to those whose heads are being treated thereon or therein. As will be disclosed in greater detail below, customers and patients can rest in greater comfort on neck/head rest 20. Even more advantageously, shampoo bowl 10 and neck/head rest 20, in combination with cushion 30, not only provides comfort for the client/patients neck and head but also provides more functionality and advantages for the stylist or specialist treating/attending to the customer or patient, as the case may be.

As will be also be disclosed in greater detail below, a preferred dimension of neck/head rest 20 at the section where the neck of the person, customer, or patient will lie against is preferably two and one half (2.5) inches to five (5) inches in radius of foam at the point of contact between the neck and the foam.

Preferably but not necessarily, shampoo bowl 10 and neck/head rest 20 will fit onto existing adjustable chair/shampoo bowls called a "backwash." In a preferred embodiment, shampoo bowl 10 is a ceramic bowl, and will be made to accommodate a molded polyurethane/silicone/EVA neck/head rest 20, which itself is preferably made of polyurethane, silicone, ethylene vinyl acetate and/or combinations of the foregoing.

Figure 2:
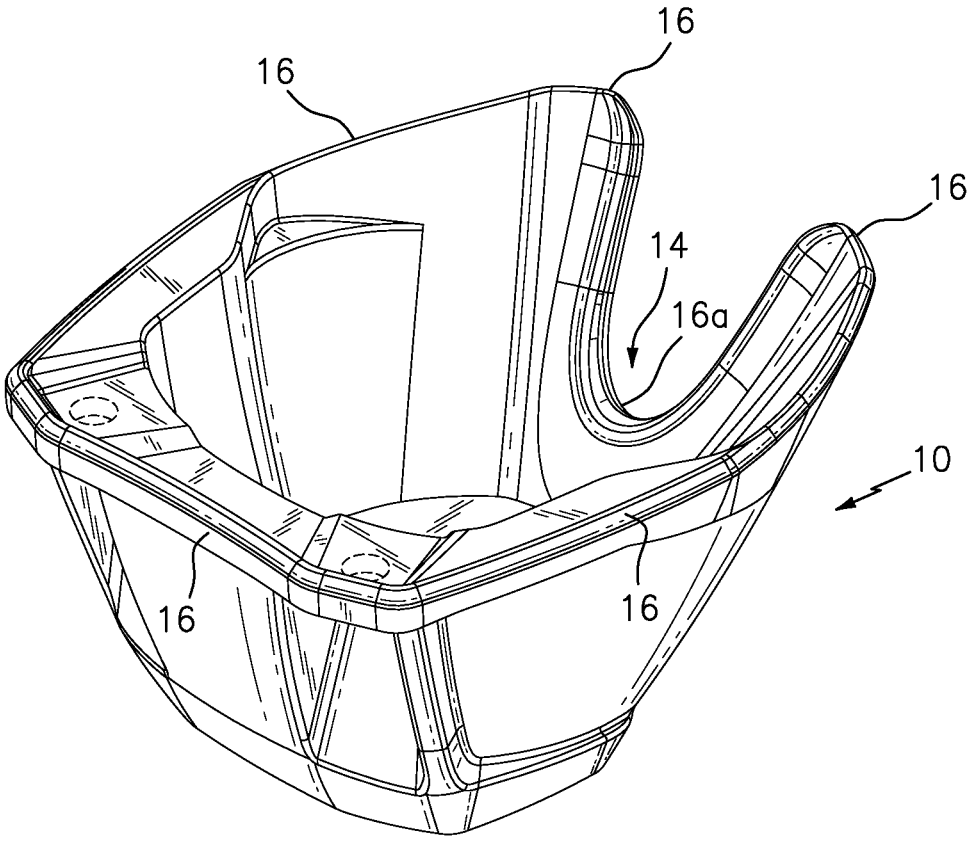
Figure 3:
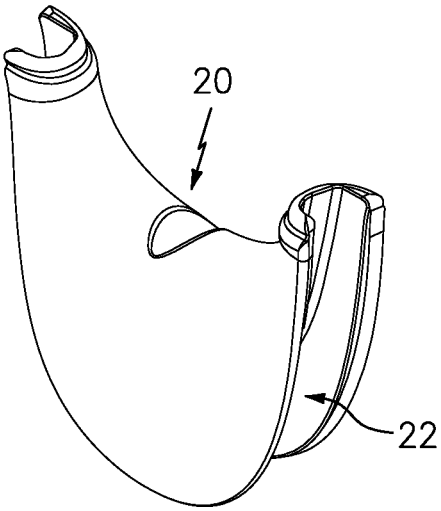
FIG. 3 is a perspective view of a neck/head rest constructed in accordance with preferred embodiments of the present invention.
Figure 4:
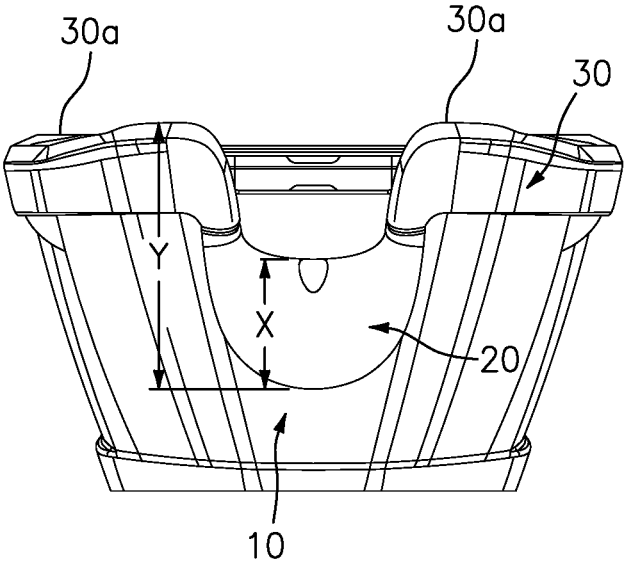
FIG. 4 is a perspective view of the shampoo bowl of FIGS. 1 and 2 and the neck/head rest of FIG. 3 being integrated into a single unit in accordance with preferred embodiments of the present invention.

Reference is first made to FIGS. 1-4, 6 and 7, which illustrate certain features, functions and advantages provided by a first embodiment of the present invention. For example, FIGS. 1 and 2 illustrate a preferred construction of shampoo bowl 10, while FIG. 3 illustrates a preferred construction of the neck/head rest, generally indicated at 20, and FIG. 4 illustrates a first embodiment of the combination shampoo bowl 10, neck/head rest 20 and cushion 30 combination/system.

In more particular detail, the shampoo bowl and neck/head rest combination of a first embodiment comprises the shampoo bowl 10, having at least one side 12 for receiving a neck area and/or a head area of a person receiving a hair washing, hair cutting, massaging and/or hair coloring procedure. The at least one side 12 of the shampoo bowl 10 for receiving the neck and/or head area has a recessed area, generally indicated at 14, for receiving the neck/head rest 20. Preferably, the portion of the neck/head rest 20 that is positioned at a lowermost edge 16*a* of the recessed area 14 is at least three (3) inches thick, and preferably at least three and one half (3.5) inches to five (5) inches thick, as indicated in FIG. 4 by way of reference to reference "X." In this way, many if not all of the advantages and objectives of improved comfort to the person whose hair/head is being washed, cut, massaged and/or colored as set forth herein are achieved. In a specific preferred embodiment, neck/head rest 20 is integrated into the shampoo bowl in the recessed area 14. Preferably, neck/head rest 20 has a recessed channel, generally indicated at 22, which is preferably press fit onto edge 16*a* of the shampoo bowl 10 in the recessed area 14. In this way, the neck/head rest 20 is (and can be) removable from the shampoo bowl 10 for cleaning, replacement, inspection, etc.

In a preferred embodiment, the shampoo bowl 10 is ceramic and the neck/head rest 20 comprises polyurethane, silicone, ethylene vinyl acetate and/or combinations of the foregoing. In addition or alternatively, neck/head rest 20 may be coated foam.

Figure 6:
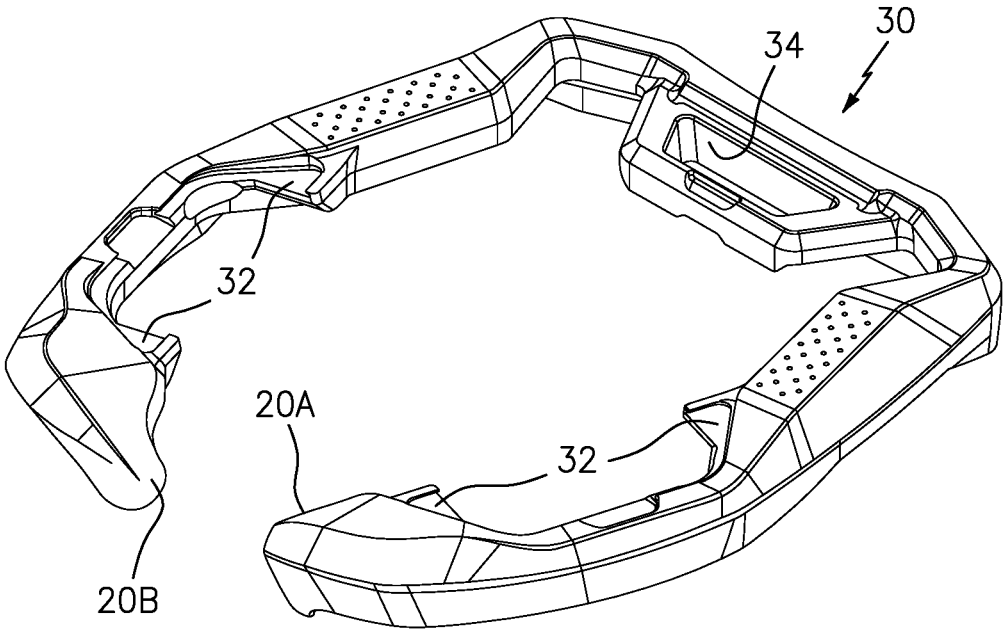
FIGS. 6 and 7 are perspective views of a cushion constructed in accordance with preferred embodiments of the present invention.
Figure 7:
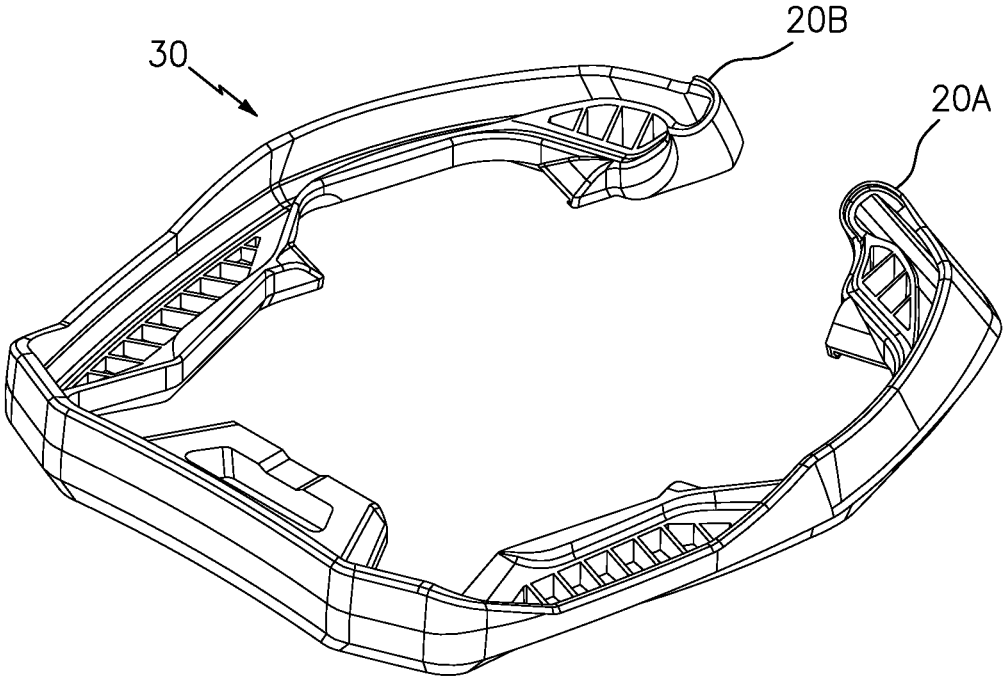
Figure 8:
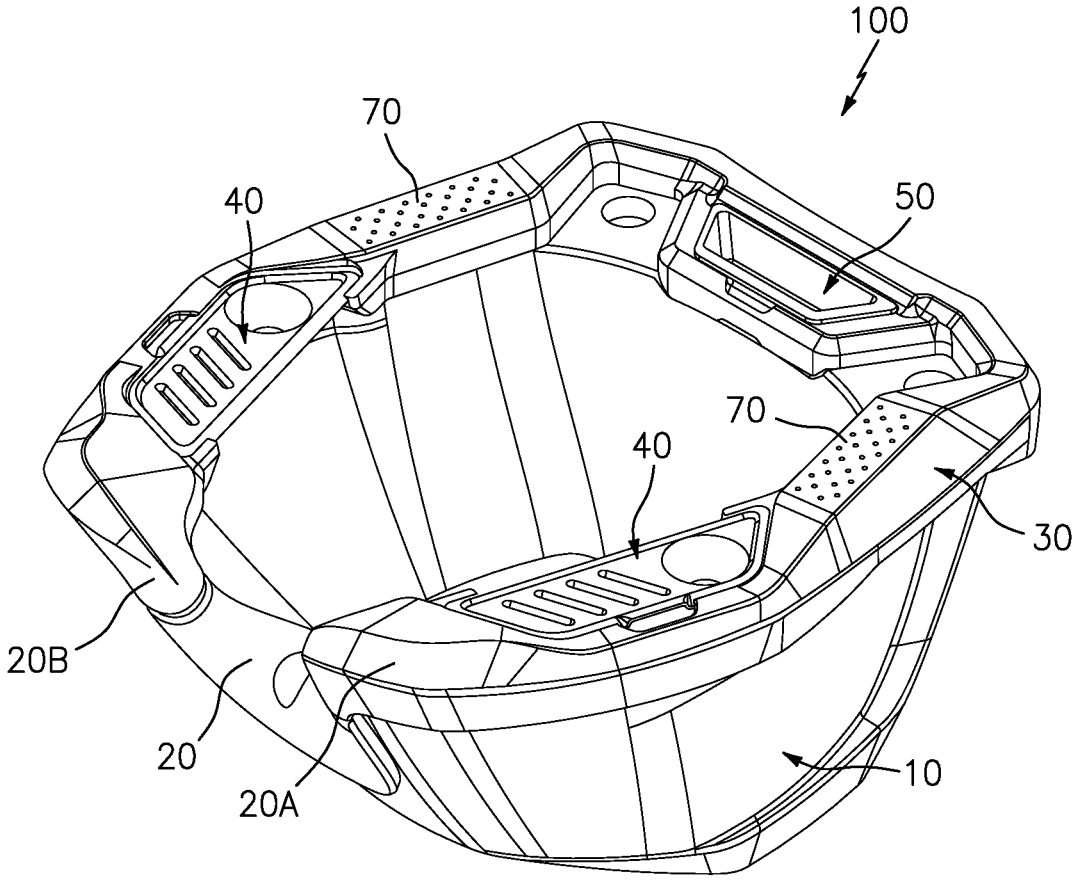
FIG. 8 is a perspective view of a shampoo bowl system constructed in accordance with preferred embodiments of the present invention.

In a most preferred embodiment, the present invention contemplates and provides for the further incorporation of the cushion 30, with reference also being made to FIGS. 6, 7, which are particularly directed thereto, along with reference to FIG. 8 also being had for the convenience of the reader, which shows an exemplary shampoo bowl system, generally indicated at 100, that includes shampoo bowl 10, neck/head rest 20 and cushion 30, as more fully disclosed herein.

Cushion 30 extends along at least a portion of a top edge 16 (FIGS. 1, 2) of the shampoo bowl 10. Preferably, cushion 30 extends along the majority of and preferably, along the entire periphery of the top edge 16 of shampoo bowl 10. That is, as illustrated, the preferred construction of cushion 30 has end regions 20A, 20B between which is positioned neck/head rest 20. In this way, neck/head rest 20 can be independently removable and separate from cushion 30. However, in the preferred embodiment, cushion 30 and neck/head rest 20 are integrated as one unit, e.g. integrated as one piece of material. Preferably, the recessed area 14 lies at least ten (10) inches below a top edge 30A of the cushion 30, as referenced by reference "Y" as shown in FIG. 4.

Figure 5B:
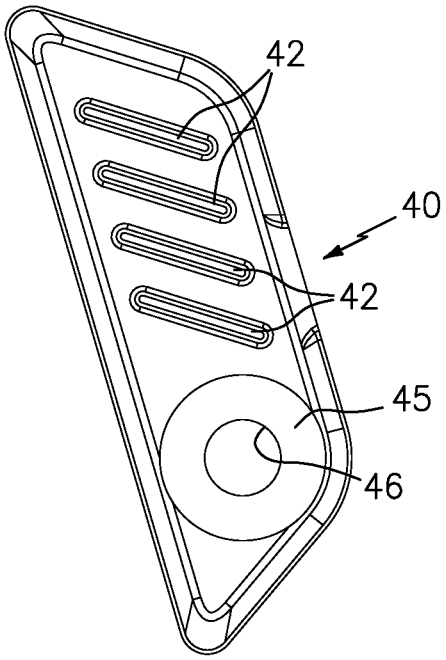
FIGS. 5A, 5B illustrate a hair sectioner constructed in accordance with a preferred embodiment of the present invention.
Figure 5A:
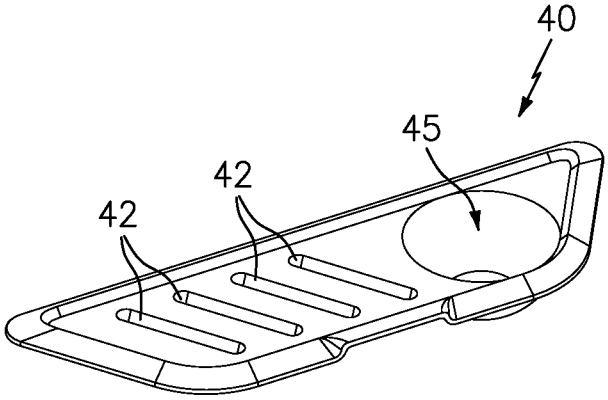
Figure 5C:
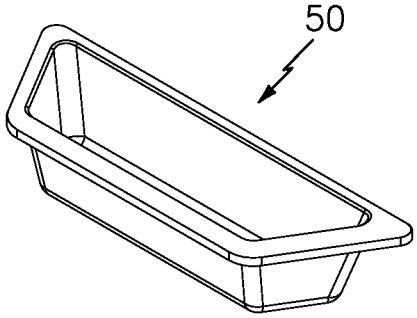
FIG. 5C illustrates a color bowl constructed in accordance with a preferred embodiment of the present invention.

In accordance with further objectives and advantages of the present invention, reference will also now be made to additional FIGS. 5A, 5B and 5C, which respectively illustrate the preferred accessories, namely, a hair sectioner 40 (perspective, top views, respectively) and a bowl 50, each of which is preferably removable from cushion 30. References will now be more particularly made thereto.

For example, in another preferred embodiment, the present invention is directed to a shampoo bowl arrangement comprising the shampoo bowl 10, wherein, as disclosed above, the shampoo bowl 10 is dimensioned to receive a neck area and/or a head area of a person during a hair washing, hair cutting, massaging and/or hair coloring procedure, and includes one or more accessories, couplable to the bowl and utilizable during the hair washing, hair cutting, massaging and/or hair coloring procedure. By "utilizable," it is meant that the one or more accessories facilitate one or more of the hair washing, hair cutting, massaging and/or hair coloring procedures as will be disclosed and/or made apparent from the following.

Figure 9A:
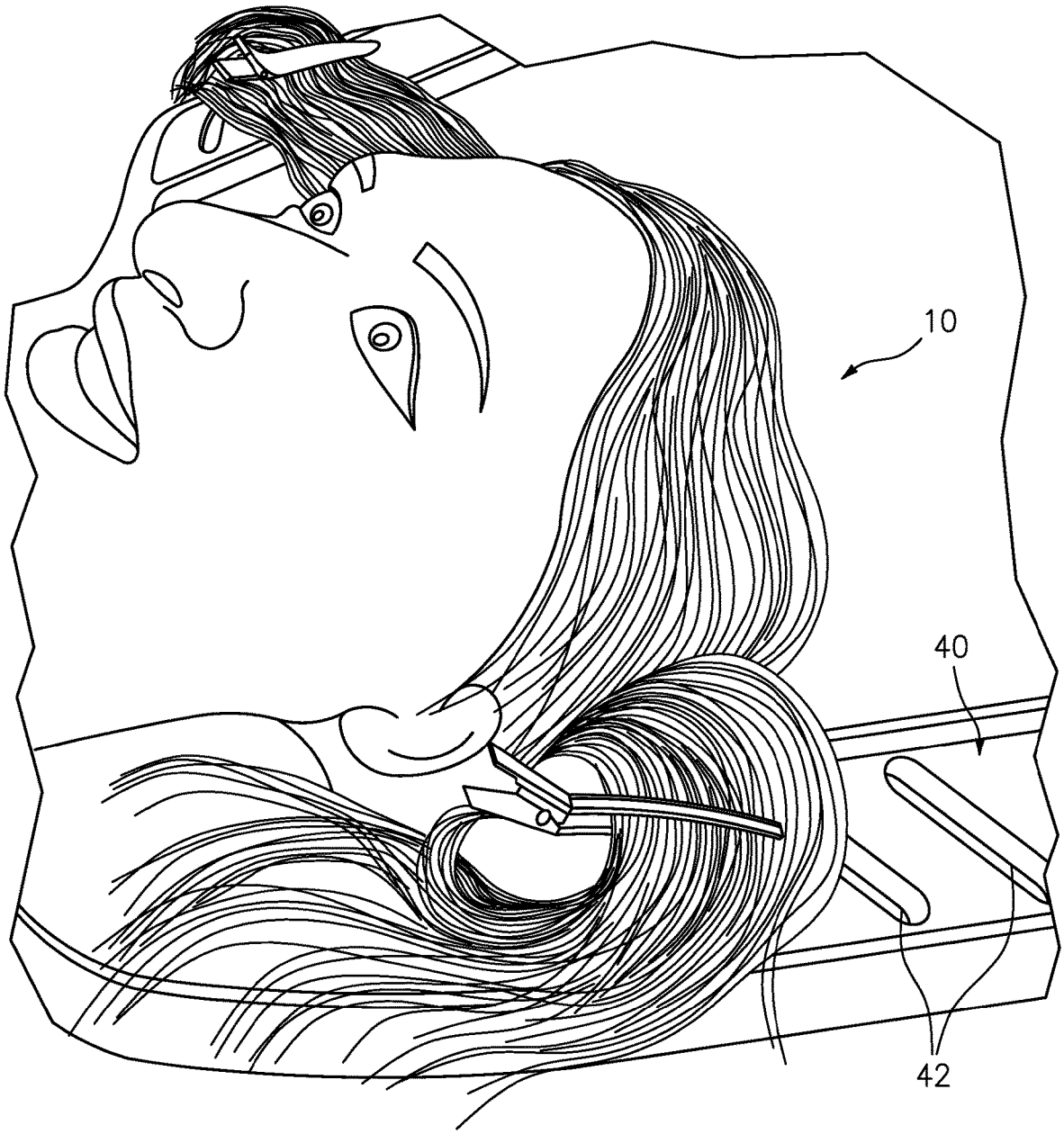
FIGS. 9A, 9B, 9C illustrate sections of hair being coupled to a hair sectioner as disclosed herein.
Figure 9B:
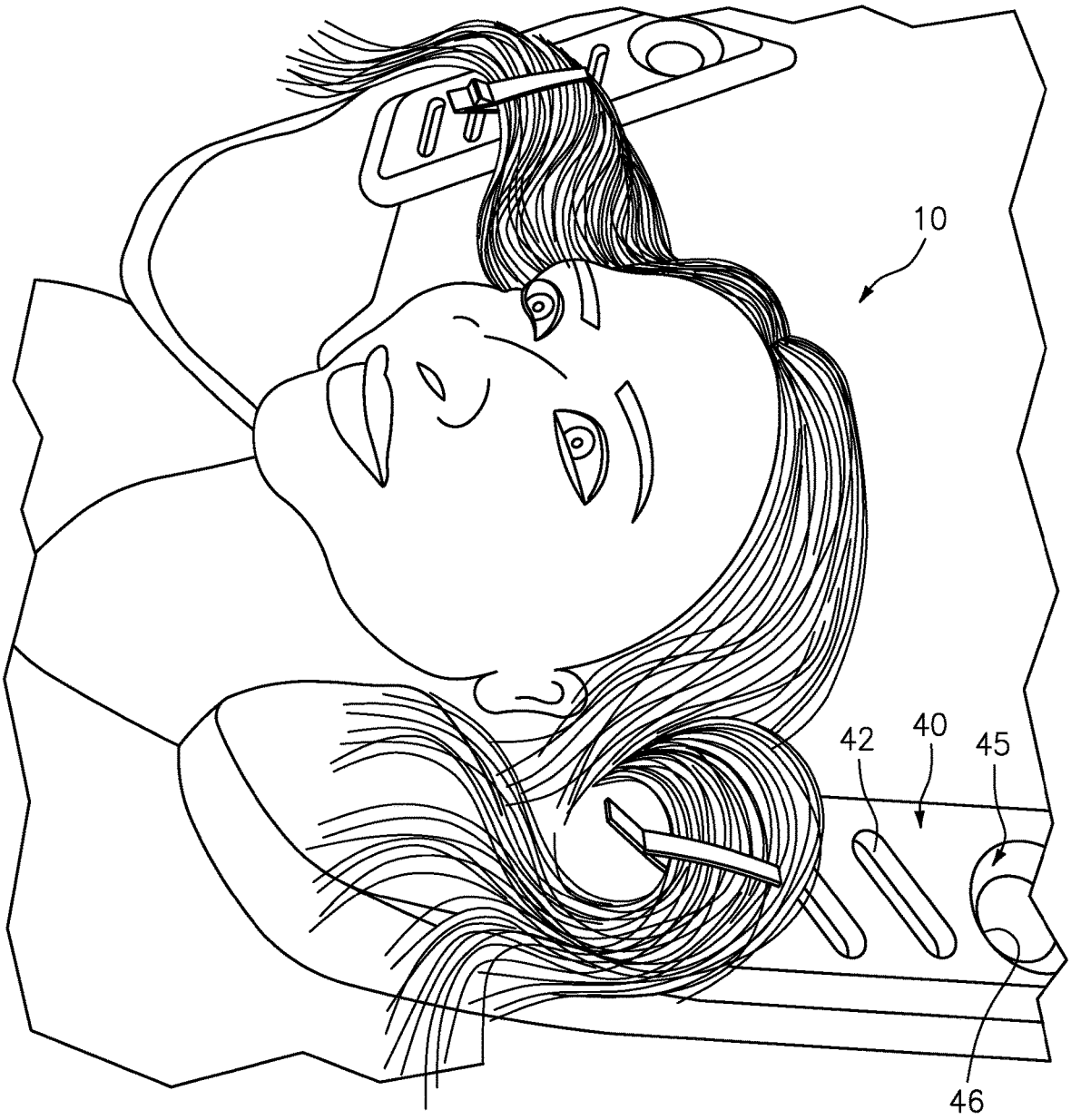
Figure 9C:
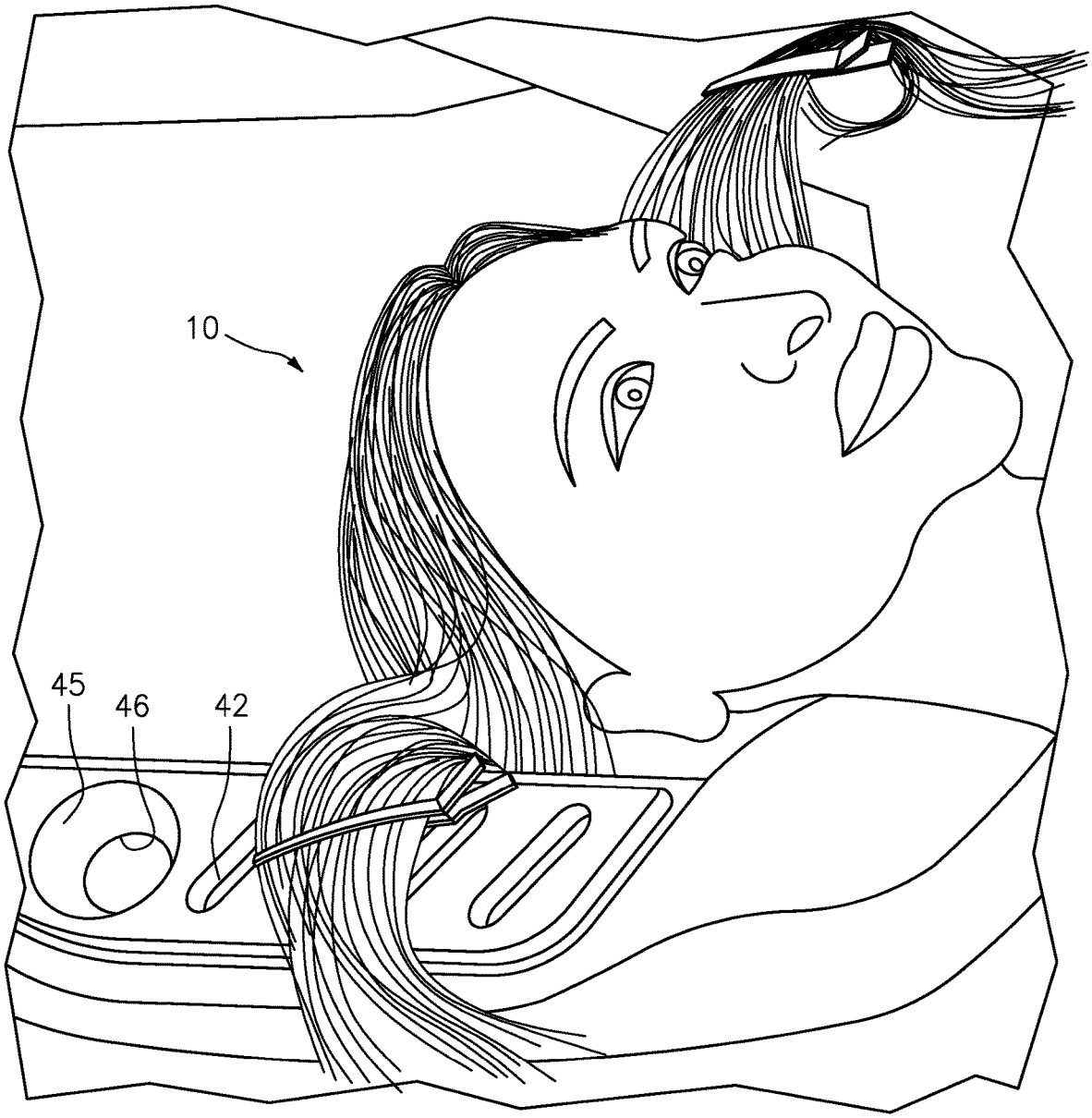

For example, in a specific preferred embodiment, the one or more accessories is the hair sectioner, generally indicated at 40. The at least one hair (and preferably at least two (2)) sectioner(s) 40 comprises a plurality of slots 42 to which one or more clips 90 are securable, as illustrated in exemplary FIGS. 9A, 9B, 9C. In this way, one or more sections of hair of the person are couplable to the at least one hair sectioner 40 with the one or more clips being couplable to the one or more of the plurality of slots 42. This feature of the hair sectioner with a plurality of slots 42 is particularly advantageous during a hair procedure where separation of hair sections is needed. In known procedures of this type, a second stylist or assistant is usually needed to hold such sections while the primary stylist is working on the person's hair. By incorporating a hair sectioner as disclosed and claimed herein, a single stylist or salon worker can achieve the same results and achieve the same objectives that heretofore required two people.

Figure 10:
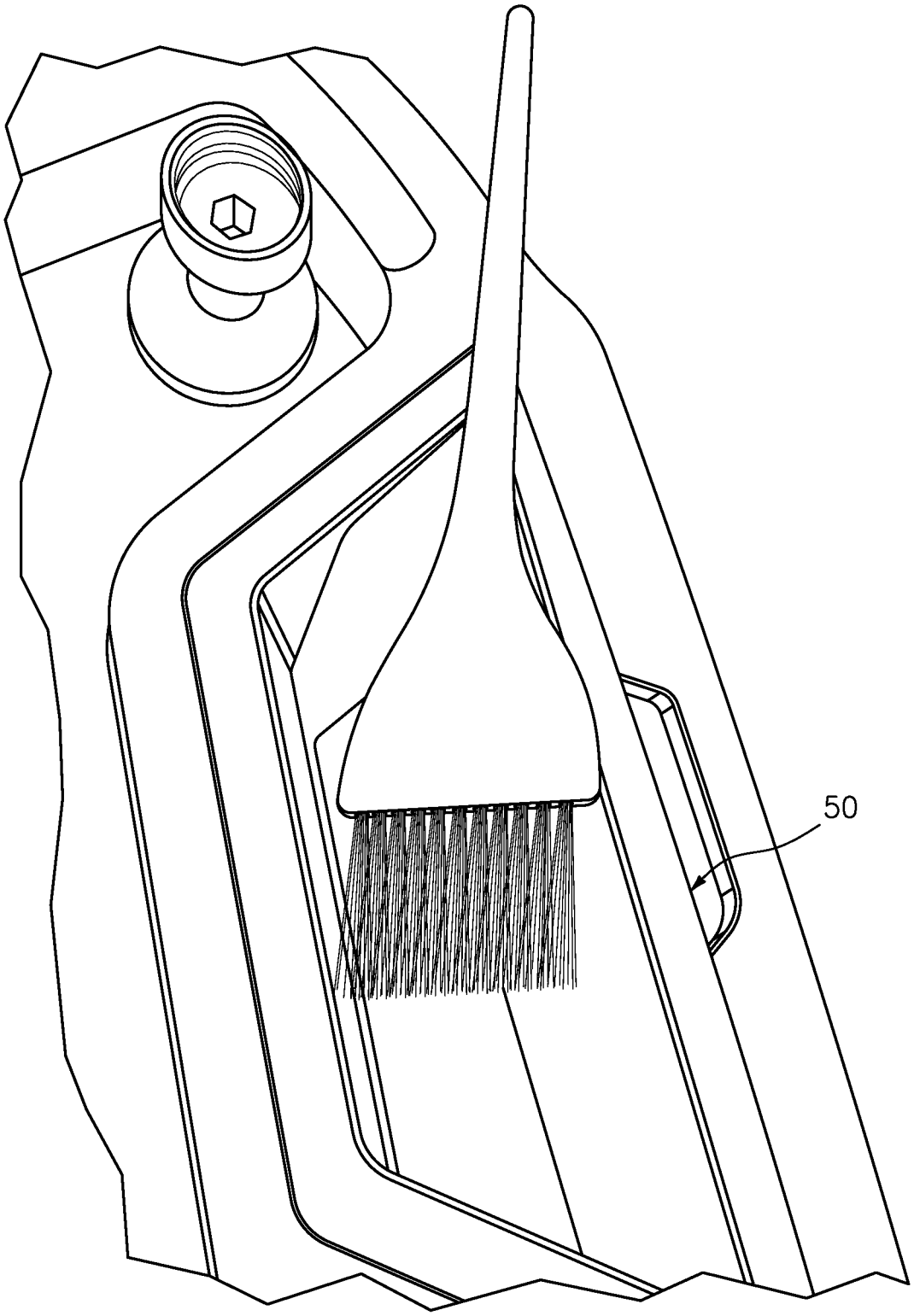
FIG. 10 illustrates a hair sectioner as disclosed herein comprising a receptacle with an opening at a bottom of the receptacle for receiving a liquid dispensing tip of an inverted bottle, wherein the tip extends into the opening of the receptacle.

In yet another preferred embodiment, the at least one hair sectioner 40 further comprises a receptacle, generally indicated at 45, with an opening 46 at a bottom of the receptacle 45 for receiving a liquid dispensing tip of an inverted bottle, as illustrated in FIG. 10, wherein the tip is preferably extendable into the opening of the receptacle while the inverted bottle is retainable in the receptacle 45. Such a feature facilitates the use of such dispensing bottles, whether filled with hair coloring or hair treatment liquids and helps keep the color or other liquid at the dispensing end of the bottle to make dispensing easier.

In yet another preferred embodiment, the one or more accessories comprises the at least one bowl 50, for receiving hair coloring liquid and/or conditioning treatment. As would be known to those in the field of hair styling, cutting or treatment, facilitating access to one or more hair coloring liquid and/or conditioning treatment bowls in a shampoo arrangement is a huge advantage not found in the prior art. Moreover, having such a bowl 50 be removable for cleaning, replacement or the like is a further advantage and objective of the present invention not found in the prior art. In a specific embodiment, the at least one removable bowl 50 has square corners for supporting one or more color brushes.

While it is contemplated that shampoo bowl 10 can be molded/shaped and/or otherwise provided with the needed supports, shoulders, receptacle(s) and features (as discussed below) to accommodate the accessories disclosed herein, in a preferred embodiment, cushion 30 is provided therefor, again, with reference being made to FIGS. 6, 7, and 8 as mentioned above.

In an embodiment comprising cushion 30, it can be seen that the one or more accessories can be, and advantageous are, coupled to the cushion 30. For example, as shown in FIG. 8, the at least one hair sectioner 40 is supported on the cushion 30. Preferably, cushion 30 comprises one or more shoulders 32 (see e.g. FIG. 6), extending from the interior section of cushion 30, for supporting the at least one hair sectioner 40. As shown in FIG. 8, hair sectioner 40 is preferably provided on each side of the cushion 30 to facilitate any procedure in which sectioning of the person's hair is needed or desired. As also can be seen, each of the preferred hair sectioners 40 in FIG. 8 is provided with the aforementioned receptacle 45 with an opening 46 at a bottom thereof for receiving a liquid dispensing tip of an inverted bottle. Again, a plurality of such receptacles facilitates access to the needed or desired hair coloring liquid and/or conditioning treatment bottles.

With a preferred embodiment of the present invention incorporating the aforementioned at least one (and preferably, but not necessarily, removable) bowl 50 for receiving hair coloring liquid and/or conditioning treatment, the cushion 30 preferably comprises a support 34 in the form of a correspondingly shaped recess for receiving and supporting the at least one removable bowl 50 on the cushion 30.

As can thus be seen, the present invention is extremely advantageous to a person who is receiving the hair washing, hair cutting, massaging and/or hair coloring procedure, as well as extremely helpful, functional and "user friendly" to the stylist or professional or other trained personnel attending to the person being treated. The foregoing embodiments highlight the many varied and separately advantageous functions and features of the present invention. However, in an even more advantageous embodiment, the present invention may incorporate all of the foregoing into one shampoo bowl system, comprising, for example:

- a shampoo bowl 10 having at least one side 12 for receiving a neck area and/or a head area of a person receiving a hair washing, hair cutting, massaging and/or hair coloring procedure, wherein the at least one side 12 of the shampoo bowl for receiving the neck and/or head area has a recessed area 14 for receiving a neck/head rest 20;
- a neck/head rest 20, wherein a portion of the neck/head rest that is positioned at a lowermost edge 16*a* of the recessed area is at least three (3) inches and preferably at least 3.5 to 5 inches thick;
- a plurality of accessories 40, 50, couplable to the bowl 10, wherein the plurality of accessories comprises:
  - i. at least one hair sectioner 40, wherein the at least one hair sectioner comprises:
    - a plurality of slots 42 to which one or more clips are securable, whereby one or more sections of hair are couplable to the at least one hair sectioner 40 with the one or more clips being couplable to the one or more of the plurality of slots 42; and
    - a receptacle 45 with an opening 46 at a bottom thereof for receiving a liquid dispensing tip of an inverted bottle, wherein the tip is extendable into the opening of the receptacle while the inverted bottle is retainable in the receptacle;
  - ii. at least one removable bowl 50 for receiving hair coloring liquid and/or conditioning treatment; and
- a cushion 30, wherein the cushion 30 extends along at least a portion of top edge 16 of the shampoo bowl 10, and wherein the cushion comprises a support 34 for supporting and preferably providing for the removal of the at least one bowl on the cushion 30 and a support 32 for supporting and providing for the removal of the at least one hair sectioner 40 on the cushion.

While the foregoing embodiments highlight some of the more important features of the present invention, there are still yet further features, embodiments and advantages of the present invention.

For example, the shampoo bowl system of the present invention may, in addition to the foregoing, include one or more of the following, namely, adjustable shelves, tool accessory cups, additional bowls for hair color or other hair treatment procedures, hair sectioners to keep portions of hair out of the bowl, bottle holders to secure color application bottles, shampooing or other bottles, and/or a trap screen at the base of the shampoo bowl in the drain. In fact, as illustrated in FIG. 8, the present invention includes arm supports 70 for the salon/hair care personnel, thus providing the salon/hair care personnel worker with a physically comfortable work environment during the hair care procedure.

As will thus be appreciated, the present invention, and in particular, the combination of shampoo bowl 10 and neck/head rest 20, and with cushion 30 (and preferably where neck/head rest 20 and cushion 30 are an integrated unit, e.g. made of one piece), provides benefits as disclosed above, including but not limited to (i) increased comfort for the customer/patient's head and neck based on ergonomic shape (to support head and neck), density and thickness of neck/head rest 20; (ii) increased comfort for the salon stylist or hospital personnel, as cushion 30 provides padding around edges of shampoo bowl 10 where the stylist/personnel may lean on and place their elbows and forearms during use; (iii) the inclusion of accessory cups as these areas can have different cups for different purposes, and can be swapped out for different cups that serve different purposes; (iv) providing anti-bacterial properties, i.e. the shampoo bowl 10, neck/head rest 20 and cushion 30 materials are chosen to inhibit or prevent bacterial growth; (v) improved removability and cleanability, i.e. shampoo bowl 10, neck/head rest 20 and cushion 30 are each designed for easy removability for, for example, easy cleaning thereof; and (vi) the inclusion of hair separators, i.e. the two front cups are designed with hair separators and drainage channels, which assists the stylist/specialist in separating hair during a coloring process.

Figure 11:
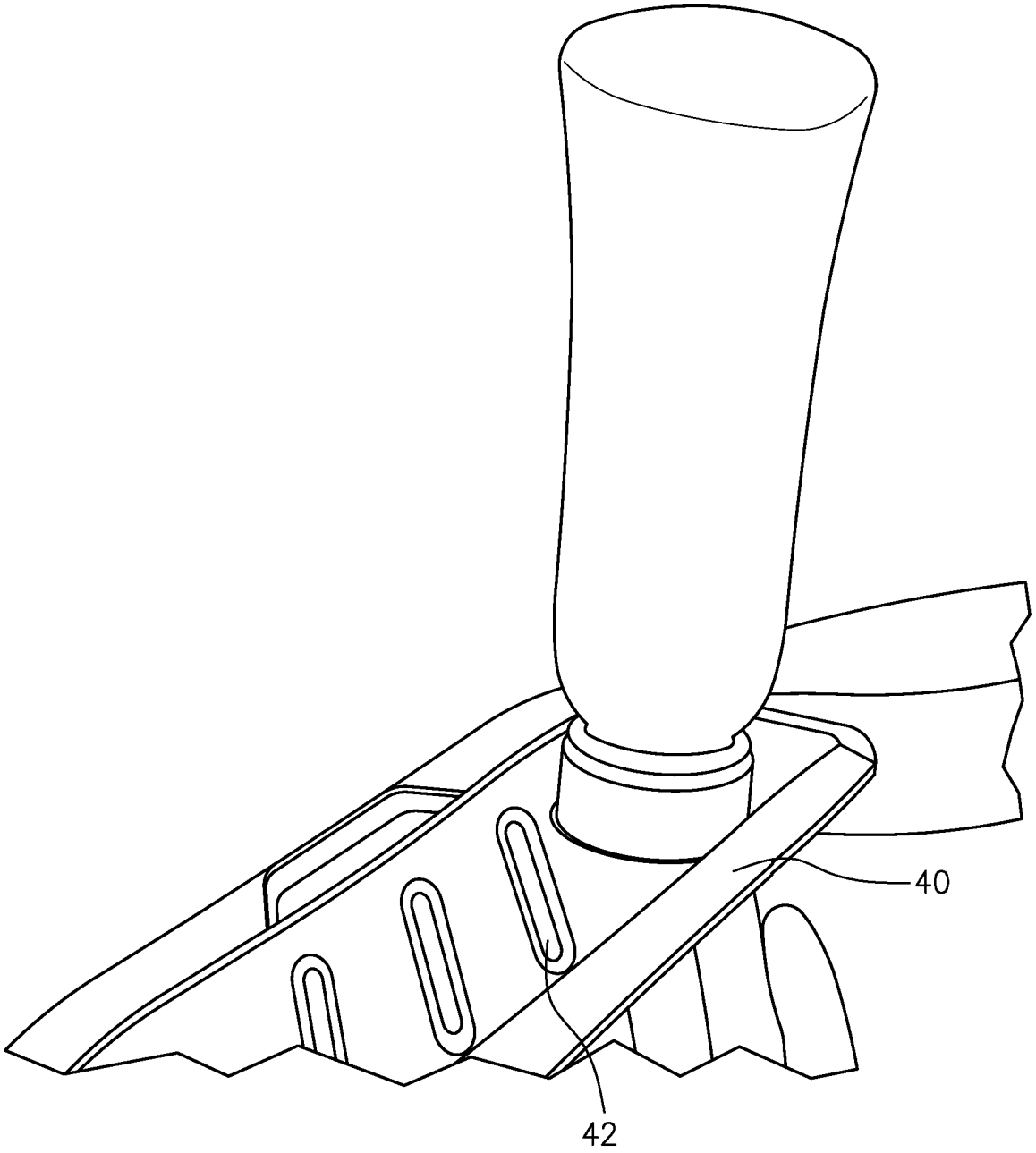
FIG. 11 illustrates a preferred color bowl with square corners so one or more color brushes can rest securely on the corners of the color bowl during an application.

As should now also be appreciated, the features disclosed herein are not found in the prior art. For example, with respect to the hair sectioners 40 being incorporated into the shampoo bowl system as disclosed herein, such hair sectioners 40 facilitates the sectioning of the hair when doing a color application in the shampoo bowl 10, as the stylist/personnel can easily clip the hair to these sectioners 40 and slots 42. With respect to the removable color bowl 50, this area facilities applying color and conditioning treatments in the shampoo bowl 10. The bowl 50 can be removed, cleaned and weighed just like any other color bowl and then attached back in securely for easy application at the shampoo bowl 10. The color bowl 50 is designed with square corners so the color brush can rest securely on the corners of the color bowl during application, as illustrated in FIG. 11. Regarding the color bottle holder 45, this area is integrated into the hair sectioner 40 to make using a color bottle easier at the shampoo bowl 10. This area 45 securely holds a color bottle upside down to where the hair color will stay at the dispensing end of the bottle for easy application so it's not so hard to have to continue to shake the color out of the bottle. And equally important is the comfort to the person being treated by way of the aforementioned neck/head rest 20. Here, the curvature in the neck area of bowl 10 is deeper to allow for a thicker neck rest/cushion than heretofore provided, so that those persons being treated do not feel any barrier or discomfort when their head/neck is lying therein with the head extending into the bowl 10. Preferably, this head/neck rest 20 is integrated into the bowl and is not a separate item.

As thus should now be understood by those skilled in the art, the present invention overcomes all of the aforementioned deficiencies while also providing the advantages mentioned herein as well as those advantages that should be understood by those skilled in the art. For example, and to summarize, the present invention provides for additional comfort for the person whose head is residing therein and/or thereon. Preferred embodiments make the invention so comfortable that you cannot feel any barrier at the neck, which provides for shampooing and massaging to be as enjoyable as possible. As should be understood, the area of the bowl where the neck sits is one aspect of the present invention patentable. In addition, the other tools and features on the shampoo bowl of the present invention make the shampoo bowl of the present invention more functional for hairdressers and other professionals or personnel using the bowl. As also discussed above, the present invention preferably includes a color bowl at the base of the shampoo bowl for easy color applications. Another aspect that may be incorporated in the present invention is hair clips on the sides to help section and clip hair when coloring. Still further, a color bottle holder may be provided where the bottle can be left upside down so reapplying with color is easy (i.e. the color is already at the top of the bottle so no need to reshake bottle to get color to the top). Also under the bottle holder, another advantageous aspect is an area so color can freely flow into drain and the shampoo bowl can easily be cleaned. Still further, a removable circular screen at the base of bowl may be provided so it can act as a hair trap for the access hair and debris that would go into the drain. Still further, the shampoo bowl of the present invention is very strong and easily able to clean and be replaced.

Other advantages and objectives are deemed to be apparent from the disclosure herein. It should also be appreciated that the present invention can be implemented and utilized in numerous ways.

While the present invention has been described with respect to preferred embodiments, those skilled in the art will readily appreciate that various changes and/or modifications can be made to the invention without departing from the spirit or scope of the invention.

The invention claimed is:

1. A shampoo bowl arrangement, comprising:

a bowl, the bowl dimensioned to receive a neck area and/or a head area of a person during a hair washing, hair cutting, massaging and/or hair coloring procedure;

one or more accessories, couplable to the bowl and utilizable during the hair washing, hair cutting, massaging and/or hair coloring procedure;

wherein the one or more accessories comprises at least one hair sectioner, wherein the at least one hair sectioner comprises a plurality of slots to which one or more clips are securable, wherein one or more sections of hair are couplable to the at least one hair sectioner with the one or more clips being couplable to the one or more of the plurality of slots; and wherein the at least one hair sectioner further comprises a receptacle with an opening at a bottom thereof for receiving a liquid dispensing tip of an inverted bottle, wherein the tip is extendable into the opening of the receptacle while the inverted bottle is retainable in the receptacle.

2. The shampoo bowl arrangement as claimed in claim 1, wherein the bowl has at least one side for receiving a neck area and/or a head area of a person receiving the hair washing, hair cutting, massaging and/or hair coloring procedure, wherein the at least one side of the bowl for receiving the neck and/or head area has a recessed area for receiving the neck/head rest; and wherein a portion of the neck/head rest that is positioned at a lowermost edge of the recessed area is at least 3 inches to 5 inches thick.

3. The shampoo arrangement as claimed in claim 2, wherein the neck/head rest is integrated into the shampoo bowl in the recessed area.

4. The shampoo bowl arrangement as claimed in claim 2, further comprising a cushion, wherein:

the cushion extends along at least a portion of a top edge of the bowl, the cushion and the neck/head rest are an integrated unit; and the recessed area for the neck/head rest is at least five (5) inches below a top edge of the cushion.

5. The shampoo bowl arrangement as claimed in claim 1, wherein the neck/head rest has a recessed channel, wherein the recessed channel is press fit onto an edge of the bowl in the recessed area.

6. The shampoo bowl arrangement as claimed in claim 5, wherein the neck/head rest is removable from the bowl.

7. The shampoo bowl arrangement as claimed in claim 1, wherein the one or more accessories comprises at least one removable bowl for receiving hair coloring liquid and/or conditioning treatment.

8. The shampoo bowl arrangement as claimed in claim 1, further comprising a cushion, wherein the cushion extends along at least a portion of a top edge of the bowl, and wherein the one or more accessories are coupled to the cushion.

9. The shampoo bowl arrangement as claimed in claim 8, wherein the cushion extends along the entire top edge of the bowl.

10. The shampoo bowl arrangement as claimed in claim 8, wherein the cushion comprises a support for supporting the at least one hair sectioner on the cushion.

11. The shampoo bowl arrangement as claimed in claim 8, wherein the bowl is ceramic and the cushion comprises polyurethane, silicone, ethylene vinyl acetate and/or combinations of the foregoing.

12. A shampoo bowl arrangement, comprising:

a bowl, the bowl dimensioned to receive a neck area and/or a head area of a person during a hair washing, hair cutting, massaging and/or hair coloring procedure;

a cushion, wherein the cushion extends along at least a portion of a top edge of the bowl, and wherein the one or more accessories are coupled to the cushion; and one or more accessories, couplable to the bowl and utilizable during the hair washing, hair cutting, massaging and/or hair coloring procedure;

wherein the one or more accessories comprises at least one hair sectioner, wherein the at least one hair sectioner further comprises a receptacle with an opening at a bottom thereof for receiving a liquid dispensing tip of an inverted bottle, wherein the tip is extendable into the opening of the receptacle while the inverted bottle is retainable in the receptacle;

wherein the cushion comprises a support for supporting the at least one hair sectioner on the cushion.

13. The shampoo bowl arrangement as claimed in claim 12, wherein the at least one hair sectioner comprises a plurality of slots to which one or more clips are securable;

whereby one or more sections of hair are couplable to the at least one hair sectioner with the one or more clips being couplable to the one or more of the plurality of slots.

14. A shampoo bowl arrangement, comprising:

a bowl, the bowl dimensioned to receive a neck area and/or a head area of a person during a hair washing, hair cutting, massaging and/or hair coloring procedure;

a cushion, wherein the cushion extends along at least a portion of a top edge of the bowl, and wherein the one or more accessories are coupled to the cushion; and one or more accessories, couplable to the bowl and utilizable during the hair washing, hair cutting, massaging and/or hair coloring procedure;

wherein the one or more accessories comprises at least one removable bowl for receiving hair coloring liquid and/or conditioning treatment; and wherein the cushion comprises a support for supporting the at least one removable bowl on the cushion.

15. A shampoo bowl system, the system comprising:

a shampoo bowl having at least one side for receiving a neck area and/or a head area of a person receiving a hair washing, hair cutting, massaging and/or hair coloring procedure, wherein the at least one side of the shampoo bowl for receiving the neck and/or head area has a recessed area for receiving a neck/head rest;

a neck/head rest, wherein a portion of the neck/head rest that is positioned at a lowermost edge of the recessed area is at least three (3) to five (5) inches thick;

a plurality of accessories comprising:

at least one hair sectioner, wherein the at least one hair sectioner comprises:

a plurality of slots to which one or more clips are securable, whereby one or more sections of hair are couplable to the at least one hair sectioner with the one or more clips being couplable to the one or more of the plurality of slots; and a receptacle with an opening at a bottom thereof for receiving a liquid dispensing tip of an inverted bottle, wherein the tip is extendable into the opening of the receptacle while the inverted bottle is retainable in the receptacle;

at least one removable bowl for receiving hair coloring liquid and/or conditioning treatment; and a cushion, wherein the cushion extends along at least a portion of a top edge of the shampoo bowl, and wherein the cushion comprises a support for removably supporting the at least one removable bowl on the cushion and a support for removably supporting the at least one hair sectioner on the cushion, and wherein a recessed area for the neck and/or head area lies at least five (5) inches below a top edge of the cushion.

16. The shampoo bowl system as claimed in claim 15, wherein the shampoo bowl is ceramic and the cushion comprises polyurethane, silicone, ethylene vinyl acetate and/or combinations of the foregoing.

17. A method of performing a hair washing, hair cutting, and/or hair coloring procedure utilizing the shampoo bowl system as claimed in claim 15, comprising the steps of:

separating sections of hair from a person whose hair is being washed, cut and/or colored;

clipping one or more sections of hair together with one or more respective clips, each clip being used to clip a section of said hair; and clipping the one or more sections of hair to the one or more of the plurality of slots of the at least one hair sectioner with the one more respective clips.

* * * * *